US007421994B2

(12) United States Patent
Harris et al.

(10) Patent No.: US 7,421,994 B2
(45) Date of Patent: Sep. 9, 2008

(54) HYDRAULIC LASH ADJUSTER HAVING A CHECK VALVE CARTRIDGE SUB-ASSEMBLY

(75) Inventors: Wayne S. Harris, Hilton, NY (US); Richard B. Roe, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 57 days.

(21) Appl. No.: 11/119,691

(22) Filed: May 2, 2005

(65) Prior Publication Data

US 2006/0016409 A1 Jan. 26, 2006

Related U.S. Application Data

(63) Continuation-in-part of application No. 10/897,885, filed on Jul. 23, 2004, now abandoned.

(51) Int. Cl.
*F01L 1/14* (2006.01)

(52) U.S. Cl. ..... 123/90.57; 123/90.5; 123/90.52; 123/90.55; 137/539

(58) Field of Classification Search ..... 123/90.57, 123/90.5

See application file for complete search history.

(56) References Cited

U.S. PATENT DOCUMENTS 4,762,100 A * 8/1988 Kowal ..... 123/90.58
5,509,385 A * 4/1996 LaVieri ..... 123/90.35
5,622,147 A 4/1997 Edelmayer
5,642,694 A 7/1997 Dura et al.
5,725,013 A * 3/1998 Premiski et al. ..... 137/454.2
5,758,613 A * 6/1998 Edelmayer et al. ..... 123/90.35
6,941,915 B1 * 9/2005 Masello et al. ..... 123/90.52
2005/0224030 A1 * 10/2005 Masello et al. ..... 123/90.55

FOREIGN PATENT DOCUMENTS

JP 03130506 A * 6/1991

* cited by examiner

*Primary Examiner*—Thomas Denion
*Assistant Examiner*—Kyle M Riddle
(74) *Attorney, Agent, or Firm*—Michael D. Smith

(57) ABSTRACT

An improved hydraulic lash adjuster including a cup-shaped adjuster body, and a plunger assembly disposed within the adjuster body. The plunger assembly includes a stepped axial bore extending from a body inner end to a central oil passage opening onto a hemispherical pivot head. A check valve cartridge sub-assembly is disposed against the step, defining a low-pressure oil chamber in the axial bore. A lash adjustment spring is disposed against the cartridge sub-assembly in a high-pressure chamber formed between the sub-assembly and the adjuster body. The cartridge sub-assembly may be used in other hydraulic lash adjusters such as are incorporated in hydraulic valve lifters.

12 Claims, 4 Drawing Sheets

HYDRAULIC LASH ADJUSTER HAVING A CHECK VALVE CARTRIDGE SUB-ASSEMBLY

RELATIONSHIP TO OTHER APPLICATIONS AND PATENTS

The present application is a Continuation-In-Part of a U.S. patent application, Ser. No. 10/897,885, filed Jul. 23, 2004 now abandoned.

TECHNICAL FIELD

The present invention relates to hydraulic lash adjusters for combustion valves of internal combustion engines; more particularly, to a hydraulic lash adjuster (HLA) wherein a plunger is operative within an HLA body; and most particularly, to an improved hydraulic lash adjuster wherein the check valve is provided in a cartridge sub-assembly.

BACKGROUND OF THE INVENTION

An HLA generally comprises a plunger slidably disposed within a cup-shaped body for fixed mounting in an internal combustion engine, which plunger may be hydraulically extended from the body to take up mechanical lash in an engine valve train. The HLA is supplied with low-pressure engine oil for conventional lubrication and for lash adjustment. A spring in a high-pressure chamber formed between the plunger and the body urges the plunger out of the body to take up mechanical lash in the valve train, thereby expanding the high-pressure chamber. A ball check valve between the low-pressure reservoir and the high-pressure chamber allows that chamber to fill with oil, thereby making the HLA hydraulically rigid. As oil escapes from the high-pressure chamber by leakage around the plunger, the lost oil is replenished through the check valve. If the effective length of the valve train shortens during the engine's cam operating cycle, positive lash is created and the HLA extends, moving the plunger to a higher position at the end of the cycle than at the beginning. Inversely, if the effective length of the valve train lengthens during the cam cycle, negative lash is created and the lash adjuster contracts, moving the plunger to a lower position at the end of the cycle than at the beginning. The latter condition typically occurs when valve train components lengthen in response to increased temperature.

A problem exists in some prior art HLA assemblies. A prior art one-piece plunger has a ball surface at its outer end with a central opening for supplying oil from the low-pressure reservoir to the socket end of an associated rocker arm assembly, the reservoir being supplied via a radial port in a sidewall of the reservoir. The inner end of the plunger comprises a seat for the check valve. See, for example, FIG. 2 in U.S. Pat. No. 5,642,694. Included below the seat as separate items are the check valve and return spring, valve cage and plunger spring.

It is more common in the art to provide an HLA plunger formed as two shorter sections—a lower section and an upper section. See, for example, FIG. 1 in U.S. Pat. No. 5,622,147. In this example, the seat for the check valve is integrally formed in the lower section of the plunger. Below the seat, as separate items, are the check valve and return spring, valve cage and plunger spring.

In the co-pending application bearing Ser. No. 10/897,885, an HLA assembly having a one piece tubular plunger is shown. A separate seat element is fitted to the plunger after the plunger is formed thereby simplifying the manufacture of the tubular plunger. Similar to the other prior art examples, the check valve and valve cage are assembled as separate pieces below the seat element.

It is a principal object of the present invention to provide a hydraulic lash adjuster including a plunger that is easier to manufacture wherein the check valve assembly is provided as a cartridge sub-assembly.

SUMMARY OF THE INVENTION

Briefly described, an HLA assembly in accordance with the invention comprises a hollow adjuster body for fixed mounting onto an engine, and a plunger assembly disposed within the hollow body. The plunger assembly includes a plunger body having a stepped axial bore extending from an inner end thereof to a central oil passage opening onto a conventional hemispherical pivot head. A check valve sub-assembly in the form of a cartridge sub-assembly is disposed against the step, defining thereby a low-pressure oil reservoir in the axial bore above the cartridge subassembly and a high-pressure oil reservoir below the cartridge sub-assembly. The plunger body is provided with an annular collector groove and entrance port for supplying lash-adjusting oil to the low-pressure reservoir. It is understood that the plunger body may be formed of induction hardenable steels, nonferrous metals, or ceramics. The plunger body is readily formed by inexpensive processes.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
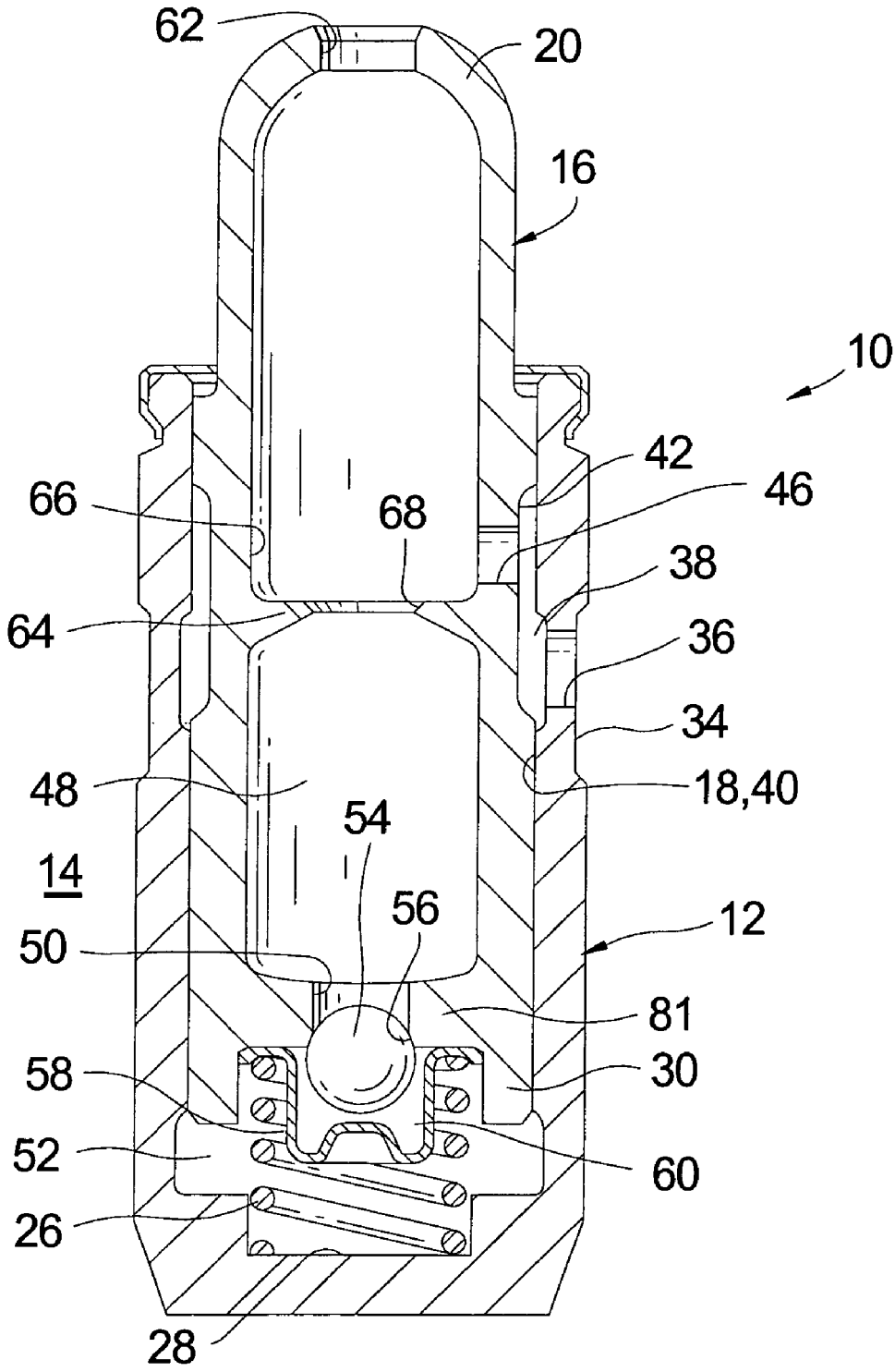
FIG. 1. (PRIOR ART)
FIG. 1 is an elevational cross-sectional view of a first prior art hydraulic lash adjuster having a one-piece plunger body.

Referring to FIG. 1, there is shown a prior art hydraulic lash adjuster, designated generally as 10, which includes a generally cup-shaped cylindrical adjuster body 12 configured to be received in an engine cylinder head 14, or other suitable installation location. The cup-shaped cylindrical body 12 forms a dash pot for a tubular one-piece plunger 16 configured for sliding disposition within the bore 18 of the body 12. In the embodiment shown, the one-piece plunger body 16 includes a semispherically shaped, upper end 20 which extends out from the body 12 for engagement with a corresponding, concave portion of a valve train rocker arm (not shown) in cylinder head 14.

A plunger return spring 26 is interposed between the bottom 28 of the cup-shaped body 12 and the lower end 30 of plunger 16 and acts to bias plunger 16 such that contact is maintained with the spherically concave portion of the rocker arm, thereby eliminating mechanical lash in the associated valve train. Fluid for the dash pot of lash adjuster 10 is in the form of oil supplied from a gallery (not shown) in the engine lubricating system. An external annular groove 34 in body 12 communicates with the gallery and through port 36 to deliver oil to annular space 38 defined by inner wall 40 of body 12 and an annular groove 42 in the outer surface of tubular plunger 16. A second port 46 extends through the plunger wall and provides a means for fluid communication between annular space 38 and low pressure chamber 48 of plunger 16.

The lower end of plunger 16 is provided with an outlet port 50 through which oil, stored within low-pressure chamber 48, may flow into high-pressure chamber 52 defined between the lower end 30 of the plunger 16 and the bottom, closed end 28 of cup-shaped body 12. Flow through outlet port 50 is controlled by a check valve, as for example in the form of a ball 54, which closes against a seat 56 encircling the lower end of the outlet port 50. A suitable valve cage 58 and valve return spring 60 limit open travel of valve ball 54 to the amount necessary to accomplish replenishment of high-pressure chamber 52 with oil which normally escapes therefrom between the sliding surfaces of tubular plunger 16 and cup-shaped body 12 as "leak-down". As shown, valve cage 58 is held against plunger 16 by plunger spring 26.

Low-pressure chamber 48 of plunger 16 extends substantially the length of the plunger, from adjacent the outlet port 50 to the semi-spherical thrust end 20. An opening 62 extends through the outer end 20 of plunger 16 to enable oil within low pressure chamber 48 to lubricate the end of the rocker arm. An integral baffle 64 is disposed within the low-pressure chamber 48 intermediate the ends of the chamber. The baffle 64 is configured as an annular shelf which extends radially inwardly from the inner wall 66 of the low-pressure chamber 48 to define a central opening 68 for the passage of oil from the oil supply port 46 to the outlet port 50.

Figure 2:
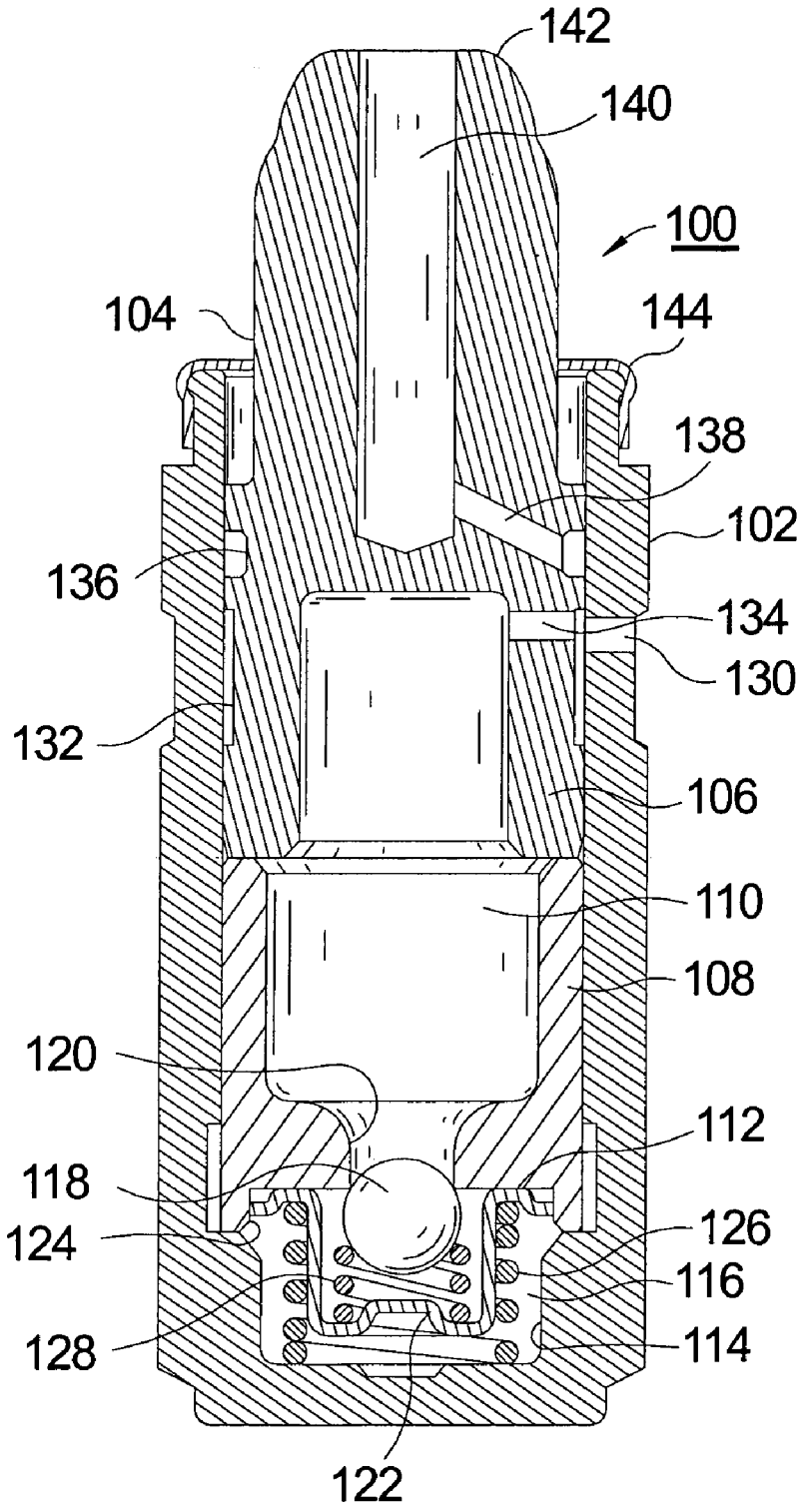
FIG. 2. (PRIOR ART)
FIG.2 is an elevational cross-sectional view of a second prior art hydraulic lash adjuster having a two piece plunger body.

Referring to FIG. 2, there is illustrated a prior art hydraulic lash adjuster 100 having a two-piece plunger, substantially as disclosed in U.S. Pat. No. 5,622,147. Adjuster 100 has a body 102, a plunger assembly 104 defined by an upper plunger element 106 and a lower plunger element 108 which are received within the body in close fitting relationship and which define a low-pressure chamber 110 between them. The bottom 112 of lower plunger element 108 forms, in cooperation with the end of a reduced diameter portion 114 of the body bore, a high pressure chamber 116. A check valve 118 is provided in the end of a passage 120 which connects the high and low pressure chambers. The check valve, which is shown as a ball but which can be a flat disk or the like, is retained by a cage 122 which is in interference fit with a counterbore 124 formed in the lower plunger element and which provides a seat for the lash adjuster plunger spring 126. In accordance with prevalent design practices, a bias spring 128 acting between the bottom of the cage 122 and the check valve 118 biases the check valve into a normally closed position.

An oil entry port 130, in communication with engine lubricating system oil gallery (not shown), opens into the body bore and intersects a collector groove 132 which intersects a radial port 134 in the upper plunger element to supply hydraulic fluid to the chamber 110. A second collector groove 136 and port 138 in the upper plunger element provides metered hydraulic fluid to an axial bore 140 to supply lubricant to a rocker arm (not shown) which engages a modified ball end 142 formed on the end of the upper plunger element, metering being provided by means of a controlled clearance between the plunger and the bore in the area of the land between the port 130 and the collector groove 136. The plunger is retained within the body by means of a cap 144.

Figure 3:
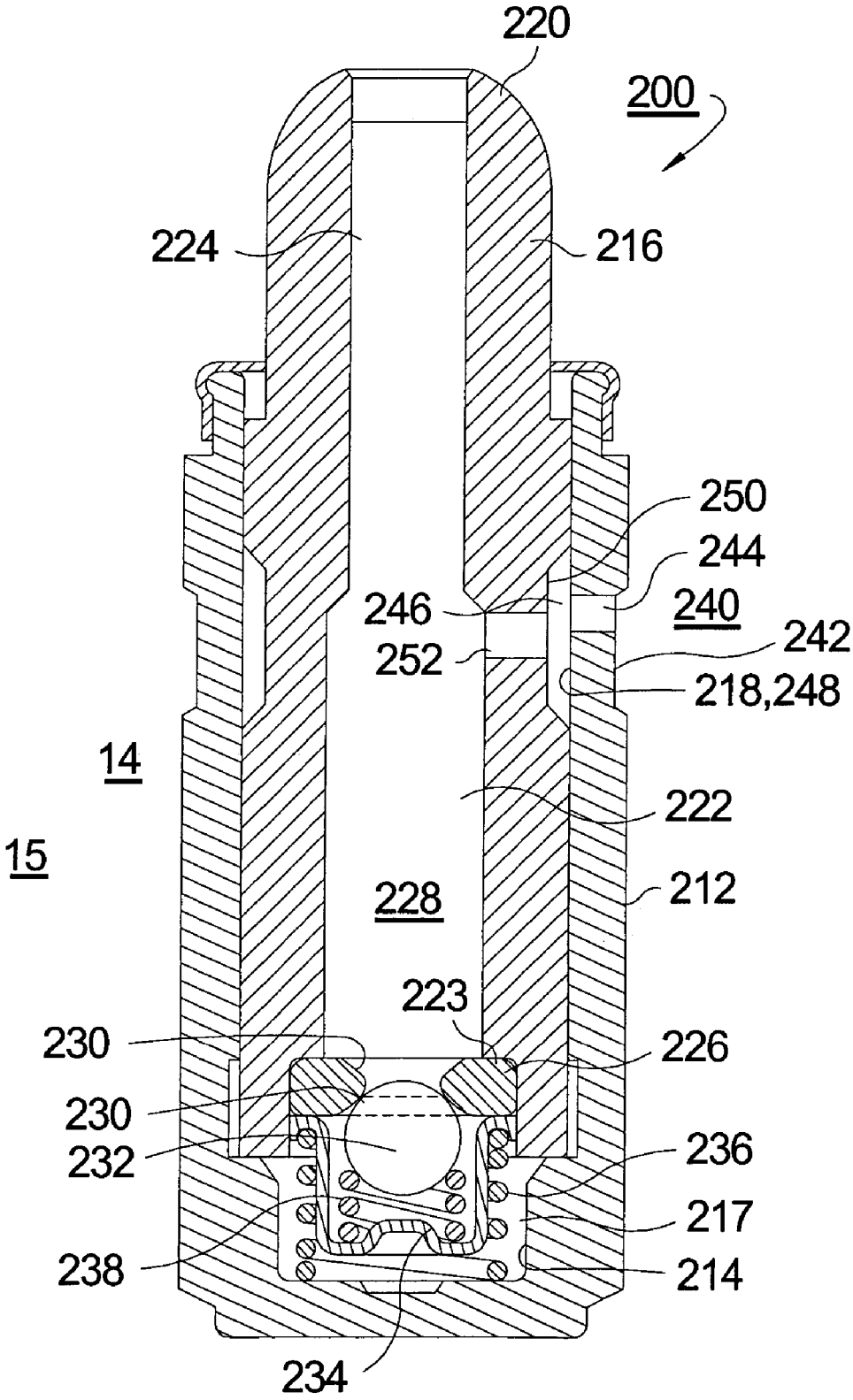
FIG. 3 is an elevational cross-sectional view of an hydraulic lash adjuster in accordance with the parent application having a plunger and separate seat element, check valve and check valve return spring.

Referring to FIG. 3, HLA assembly 200 in accordance with the invention of the parent application includes a generally cup-shaped cylindrical adjuster body 212 configured to be received in an engine cylinder head 14 of an internal combustion engine shown schematically as numeral 15. The cup-shaped cylindrical body 212 forms a dash pot for a tubular plunger 216 configured for sliding disposition within the bore 218 of the body 212. In the embodiment shown, the plunger 216 includes a semispherically shaped, outer end 220 which extends out from the body 212 for engagement with a corresponding, concave portion of a rocker arm of valve train 213 in cylinder head 14. It is understood that the plunger body may be formed of induction hardenable steels, nonferrous metals, or ceramics.

An axial bore 222 extends the length of plunger 216, preferably having a reduced diameter portion 224 extending through outer end 220 for providing oil to the rocker arm. Bore 222 is preferably stepped 223 opposite outer end 220 for receiving a separate check valve seat element 226 to close bore 222 and form thereby a low-pressure chamber 228 within plunger 216.

Seat element 226, in conjunction with tubular plunger 216 to form plunger assembly 227, is sized for a close fit within bore 222 and may be secured and sealed against bypass leakage as by welding to plunger 216. Seat element 226 includes an annular beveled seat 230 for receiving a check valve 232 to regulate flow from chamber 228 across seat 230.

Separate check valve 232 is retained by a separate cage 234 which provides a seat for the separate lash adjuster plunger spring 236. A bias spring 238 acting between the bottom of the cage 234 and the check valve 232 biases the check valve into a normally closed position. Valve cage 234 and bias spring 238 limit open travel of check valve 232 to the amount necessary to accomplish replenishment of high-pressure chamber 217 with oil which normally escapes therefrom between the sliding surfaces of tubular plunger 216 and cup-shaped body 212 as "leak-down".

Fluid for the dash pot of lash adjuster 200 is in the form of oil supplied from the engine lubricating system to a gallery 240. An external annular groove 242 in body 212 communicates through port 244 to deliver oil to annular space 246 defined by inner wall 248 of body 212 and an annular groove 250 in the outer surface of tubular plunger 216. A second port 252 extends through the plunger wall and provides a means for fluid communication between annular space 246 and low pressure chamber 228 of plunger 216.

In the embodiment 200 shown of an HLA, having a separate seat element 226 allows for, among other things, improved manufacturability of seat element 226 and the axial bore 222 of plunger 216.

Figure 4:
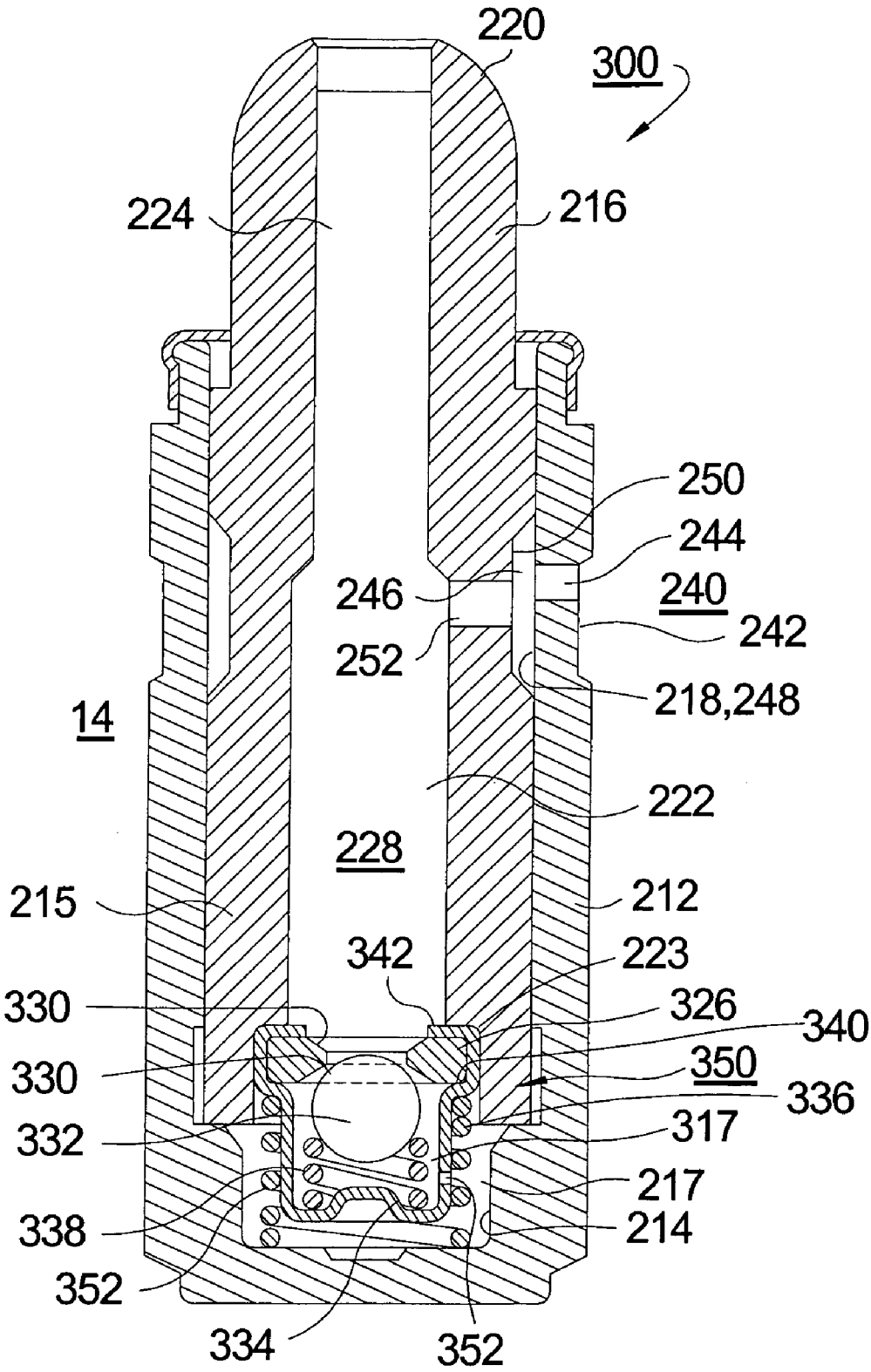
FIG. 4 is an elevational cross-sectional view of plunger like that shown in FIG. 3 but incorporating a check valve cartridge sub-assembly in accordance with the invention.

Referring to FIG. 4, a currently-preferred embodiment 300 of a hydraulic lash adjuster in accordance with the invention comprises an adjuster body 212 and a plunger assembly 215 having plunger 216 which may be identical with body 212 and plunger 216 in embodiment 200 (FIG. 3). Bore 222 of plunger 216 is stepped 223 for receiving a check valve cartridge sub-assembly 350 inserted into plunger 216 against step 223 and sealing retained by lash adjuster plunger spring 336, as in the prior art. The seal may be reinforced as by welding of the cartridge body into the plunger if so desired. The check valve included in sub-assembly 350 may be of any check-valve type, including flat plate and poppet valves (not shown) as are known in the art. As shown in FIG. 4, in an exemplary and preferred cartridge sub-assembly 350, a check valve 332 is retained by a cartridge body 334 between the cartridge body and seat element 326. Flange 340 of cartridge body 334 is formed to receive seat element 326 after which lip end 342 of flange 340 is rolled over to secure seat element 326 and check valve 332 within the subassembly cartridge. A bias spring 338 acting between cartridge body 334 and check valve 332 biases the check valve into a normally closed position. Cartridge body 334 and bias spring 338 limit open travel of check valve 332 to the amount necessary to accomplish replenishment of high-pressure chamber 217 with oil which normally escapes therefrom between the sliding surfaces of tubular plunger 216 and cup-shaped body 212 as "leak-down". Cartridge body 334 is provided with openings 352 for oil communication with chamber 217.

Providing the check valve and seat element for the HLA as a cartridge sub-assembly allows the check-valve system to be optimized for specific applications and used with a common plunger. Further, the cartridge format for the check valve greatly simplifies the overall assembly procedure. Further, the cartridge sub-assembly may be tested offline after assembly and prior to installation into the plunger, thus simplifying and making more reliable the plunger assembly and the overall HLA.

While the cartridge sub-assembly, in accordance with the invention, is shown incorporated in a hydraulic lash adjuster, it is understood that the cartridge sub-assembly may be alternately incorporated into other valve train components having a lash adjustment feature such as, for example, a hydraulic valve lifter.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A plunger assembly for use in a hydraulic lash adjuster for eliminating lash in a valve train of an internal combustion engine, comprising:

a) a plunger for sliding within a lash adjuster body, wherein an axial bore defines a low-pressure oil chamber; and b) a cartridge sub-assembly disposed in said plunger to separate said low-pressure oil chamber from a high-pressure oil chamber, said cartridge sub-assembly including a cartridge body, a check valve, and a seat element, wherein said cartridge body includes a flange with a rolled over lip end, wherein said seat element and said check valve are retained within said cartridge sub-assembly, wherein said seat element is disposed between said flange and said rolled over lip end, and wherein said rolled over lip end is substantially parallel to said flange.

2. A plunger assembly in accordance with claim 1 further comprising a port extending through a wall of said plunger body for providing oil to said low-pressure oil chamber.

3. A plunger assembly in accordance with claim 1 wherein said cartridge sub-assembly further includes a check valve bias spring.

4. A plunger assembly in accordance with claim 1 wherein said cartridge sub-assembly is welded to said plunger.

5. A plunger assembly in accordance with claim 1 wherein said rolled over lip end is in contact with a stepped portion defined in said axial bore.

6. A hydraulic lash adjuster for eliminating lash in a valve train of an internal combustion engine, comprising:

a) a lash adjuster body;

b) a plunger assembly slidably disposed in said adjuster body, said plunger assembly including a plunger having an inner end and an outer end for engaging said valve train, wherein an axial bore extends from said inner end of said plunger to communicate with said outer end, said axial bore defining a low-pressure oil chamber in said plunger, and wherein a cartridge sub-assembly is disposed in said plunger to separate said low-pressure oil chamber from a high-pressure oil chamber, said cartridge sub-assembly including a cartridge body, a check valve, and a seat element, wherein said cartridge body includes a flange with a rolled over lip end, wherein said seat element and said check valve are retained within said cartridge sub-assembly, wherein said seat element is disposed between said flange and said rolled over lip end, and wherein said rolled over lip end is substantially parallel to said flange; and c) a lash adjustment spring disposed between said lash adjuster body and said cartridge sub-assembly.

7. A hydraulic lash adjuster in accordance with claim 6 wherein said rolled over lip end is in contact with a stepped portion defined in said axial bore.

8. A plunger assembly for use in a valve train member for eliminating lash in a valve train of an internal combustion engine, comprising:

a) a plunger for sliding within an adjuster body, said plunger including an inner end and an outer end, wherein an axial bore extends from said inner end to communicate with said outer end defining a low-pressure oil chamber; and b) a cartridge sub-assembly to separate said low-pressure oil chamber from a high-pressure oil chamber, said cartridge sub-assembly including a cartridge body, a check valve, and a seat element, wherein said cartridge body includes a flange with a rolled over lip end, wherein said seat element and said check valve are retained within said cartridge sub-assembly, wherein said seat element is disposed between said flange and said rolled over lip end, and wherein said rolled over lip end is substantially parallel to said flange.

9. A plunger assembly in accordance with claim 8 wherein said rolled over lip end is in contact with a stepped portion defined in said axial bore.

10. A hydraulic lash adjuster cartridge sub-assembly for use in a hydraulic lash adjuster component, said cartridge sub-assembly comprising:

a) a cartridge body including a flange and a rolled over lip end, said rolled over lip end being substantially parallel to said flange;

b) a seat element retained within said cartridge body, said seat element disposed between said flange and said rolled over lip end; and c) a check valve contained within said cartridge sub-assembly to regulate the flow of hydraulic fluid across said seat element.

11. A method for assembling a hydraulic lash adjuster cartridge sub-assembly for use in a hydraulic lash adjuster component, said method comprising:

providing a cartridge body including a flange and a lip end;

providing a check valve;

providing a seat element having a first face and a second face;

inserting said check valve into said cartridge body;

inserting said seat element into said cartridge body so that said first face of said seat element is in contact with said flange; and rolling said lip end of said cartridge body over said second face of said seat element, wherein said seat element and said check valve are retained within said cartridge body, wherein said seat element is disposed between said flange and said rolled over lip end, wherein said rolled over lip end is substantially parallel to said flange.

12. A method in accordance with claim 11 further comprising testing the assembled hydraulic lash adjuster cartridge sub-assembly prior to installing into the hydraulic lash adjuster component.

* * * * *